US010533383B2

(12) United States Patent
McClure

(10) Patent No.: US 10,533,383 B2
(45) Date of Patent: Jan. 14, 2020

(54) APPARATUS FOR ROTATING AND CLAMPING A TUBULAR

(71) Applicant: Hawk Industries, Inc., Signal Hill, CA (US)

(72) Inventor: Mike McClure, St. Paul, MN (US)

(73) Assignee: Hawk Industries, Inc., Signal Hill, CA (US)

( * ) Notice: Subject to any disclaimer, the term of this patent is extended or adjusted under 35 U.S.C. 154(b) by 146 days.

(21) Appl. No.: 15/583,447

(22) Filed: May 1, 2017

(65) Prior Publication Data

US 2017/0314350 A1 Nov. 2, 2017

Related U.S. Application Data

(60) Provisional application No. 62/329,642, filed on Apr. 29, 2016.

(51) Int. Cl.
*E21B 19/16* (2006.01)
*E21B 17/042* (2006.01)

(52) U.S. Cl.
CPC ..... *E21B 19/161* (2013.01); *E21B 19/168* (2013.01); *E21B 17/042* (2013.01)

(58) Field of Classification Search
CPC .... E21B 19/168; E21B 19/161; E21B 19/163; E21B 19/164
See application file for complete search history.

(56) References Cited

U.S. PATENT DOCUMENTS

| | | | | |
|---|---|---|---|---|
| 4,843,924 | A | 7/1989 | Hauk | |
| 2005/0076744 | A1* | 4/2005 | Pietras | E21B 19/163 81/57.16 |
| 2009/0314137 | A1 | 12/2009 | Perez | |
| 2014/0245867 | A1 | 9/2014 | Ge | |
| 2015/0275599 | A1 | 10/2015 | Russo | |

FOREIGN PATENT DOCUMENTS

WO 2015106343 A1 7/2015

* cited by examiner

*Primary Examiner* — Kristyn A Hall
(74) *Attorney, Agent, or Firm* — Avyno Law P.C.

(57) ABSTRACT

An apparatus is provided for spinning a tubular that includes a frame having a first arm and a second arm outwardly extending from a central region where each arm includes a roller. The frame also includes a center roller coupled to the central region of the frame. The frame is also capable of functioning as a clamping mechanism by providing at least one of the rollers on the frame with an internal gear mechanism for increasing the amount of torque that can be applied to a tubular.

9 Claims, 10 Drawing Sheets

APPARATUS FOR ROTATING AND CLAMPING A TUBULAR

CROSS-REFERENCE TO RELATED APPLICATIONS

This application claims priority to U.S. Provisional Patent Ser. Application No. 62/329,642, filed on Apr. 29, 2016, titled HIGH-TORQUE ROLLER WITH INTERNAL GEARS; which application is incorporated by reference in this application in its entirety.

BACKGROUND OF THE INVENTION

1. Field of the Invention

The invention generally relates to oilfield tubular spinners and, in particular, a chainless apparatus and method for rotating a tubular and a chainless apparatus and method for clamping a tubular.

2. Related Art

In drilling for oil and gas, it is necessary to assemble a suing of drill pipe joints. Thus, a tubular drill string may be formed from a series of connected lengths of drill pipe and suspended by an overhead derrick. These lengths of drill pipe are connected by tapered external threads (the pin) on one end of the pipe, and tapered internal threads (the box) on the other end of the pipe.

During the drilling and completion of a well, as the well is drilled deeper, additional joints of pipe are periodically added to the drill string and, as the drill bit at the end of the drill string is worn, the drill string must occasionally be pulled from the well and reinstalled for maintenance purposes. The process of pulling or installing the drill string is referred to as "tripping." During tripping, the threaded connections between the lengths of drill pipe are connected and disconnected as needed. The connecting and disconnecting of adjacent sections of drill pipe (referred to as making or breaking the connection, respectively), involves applying torque to the connection and rotating one of the pipes relative to the other to fully engage or disengage the threads.

In modern wells, a drill string may be thousands of feet long and typically is formed from individual thirty-foot sections of drill pipe. Even if only every third connection is broken, as is common, hundreds of connections have to be made and broken during tripping. Thus, the tripping process is one of the most time consuming and labor intensive operations performed on the drilling rig.

Currently, there are a number of devices utilized to speed tripping operations by automating or mechanizing the process of making and breaking a threaded pipe connection. These devices include tools known as power tongs, iron roughnecks, and pipe spinners. Many of these devices are complex pieces of machinery that require two or more people to operate and require multiple steps, either automated or manual, to perform the desired operations. Additionally, many of these devices grip the pipe with teeth that can damage the drill pipe and often cannot be adjusted to different pipe diameters without first replacing certain pieces, or performing complex adjustment procedures.

In particular, roughnecks combine a torque wrench and a spinning wrench, simply called a spinner, to connect and disconnect drill pipe joints of the drill string. In most instances, the spinner and the torque wrench are both mounted together on a carriage. To make or break a threaded connection between adjoining joints of drill pipe, certain roughnecks have a torque wrench with two jaw levels. In these devices, an upper jaw of the torque wrench is utilized to clamp onto a portion of an upper tubular, and a lower jaw clamps onto a portion of a lower tubular (e.g., upper and lower threadedly connected pieces of drill pipe). After clamping onto the tubular, the upper and lower jaws are turned relative to each other to break or make a connection between the upper and lower tubulars. A spinner, mounted on the carriage above the torque wrench, engages the upper tubular and spins it until it is disconnected from the lower tubular (or in a connection operation, spins two tubulars together prior to final make-up by the torque wrench).

Generally, a spinner comprises four rollers, each driven by a separate hydraulic motor, that engage the outer wall of the drill pipe to spin the pipe. However, other spinners exists that use flexible belts or chains to engage and spin the pipe. An example of a chain spinner is the SPINMASTER® spinner made available from Hawk Industries. The basic function and construction of the SPINMASTER® spinner are disclosed in U.S. Pat. No. 4,843,924 (Hauk).

In particular, the Hauk '924 patent discloses a spinner that includes first and second elongate casing sections that are pivotally connected to each other at a pivot, and first and second driven sprockets mounted, respectively, on the casing sections at locations remote from the pivot. The spinner also includes a drive sprocket, mounted on the first casing section, driven by a motor-gear assembly and a continuous chain mounted around the drive sprocket, and around the first and second driven sprockets. The chain has an inverse internal portion adapted to receive and directly contact a tubular well element to be rotated. Cylinders connected between the casing sections pivot them toward and away from each other and thus, alternately clamp the inverse internal portion around the well element, and release such element from the inverse internal portion of the chain.

Some prior art spinners, such as the SPINMASTER®, are also adjustable to accommodate pipes of varying diameter. These spinners are adjusted by changing the location of the drive sprocket relative to the driven sprockets, thus the effective length of the chain is adjusted to accommodate different pipe diameters. While adjustable spinners are versatile, these spinners must be manually adjusted by the operator during use. In many instances, the operator must climb atop of the spinner, disengage fasteners or locking pins holding the drive sprocket in place, manually adjust the drive sprocket to a desired location, and re-fasten or lock the drive sprocket at its new location. Manually adjusting the spinner can therefore be consuming and dangerous.

To connect and disconnect adjacent sections of drill pipe, torque must be applied to the upper tubular to allow the upper tubular to rotate while the lower tubular is clamped by a clamping device. Once the connection between the upper and lower tubular becomes tight, additional higher torque must also be applied by the clamping device to the lower tubular to prevent the lower tubular from slipping or prevent it from rotating in the same direction as the upper tubular. To properly connect and disconnect adjacent sections of drill pipe, torque must be applied to both the upper and lower tubular such that upper tubulars can be rotated against the lower tubular. Rollers on prior art spinners only allow for enough torque to rotate the upper tubular while a separate clamping device is used to apply higher torque to the lower tubular.

A need exists for an improved chainless spinner that accommodates various pipe sizes, that evenly applies torque on the tubular and that is easy to repair and maintain. A need also exists for chainless piper spinners to be capable of applying additional torque to the pipes to allow the spinner to also perform the dual function of acting as a clamping device.

SUMMARY

An apparatus for spinning a tubular is provided. In one implementation, the apparatus includes a yoke having a first arm and a second arm outwardly extending in angular opposition from a central region, where each arm carries at least one rail and where the first arm and the second arm define a well therebetween. The apparatus further includes a center roller coupled to the central region of the yoke proximate the well, a first adjustable roller slidably coupled to the first arm, and a second adjustable roller slidably coupled to the second arm, where the first and second adjustable rollers may be linearly translated towards and away from the center roller.

In another implementation, the apparatus includes a frame having at least one arm outwardly extending from a central region, and a drive roller detachable coupled to the at least one arm.

A method of rotating a tubular is also provided. The method includes providing a spinner having a central roller, a first adjustable roller, and a second adjustable roller, where a well is defined by the central roller, the first adjustable roller and the second adjustable roller. The method further includes positioning the spinner about the tubular such that the tubular is received by the well, translating the adjustable rollers linearly towards the center roller, engaging the tubular by the rollers such that the tubular is gripped by the rollers at three points, and driving at least one roller to spin the tubular.

In another implementation, an apparatus for spinning or clamping a tubular is provided. The apparatus includes a yoke having a first arm and a second arm outwardly extending in angular opposition from a central region, wherein each arm carries at least one rail and wherein the first arm and second arm define a well there between. The apparatus further includes a center roller coupled to the central region of the yoke proximate the well, a first adjustable roller slidably coupled to the first arm, and a second adjustable roller slidably coupled to the second arm, where the first and second adjustable rollers may be linearly translated towards and away from the center roller. Further, the first, second and center roller of the apparatus all include internal gears to allow additional torque to be applied to the tubular when it is desired to having the apparatus clamp the tubular.

Other devices, apparatus, systems, methods, features and advantages of the disclosure will be or will become apparent to one with skill in the art upon examination of the following figures and detailed description. It is intended that all such additional systems, methods, features and advantages be included within this description, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
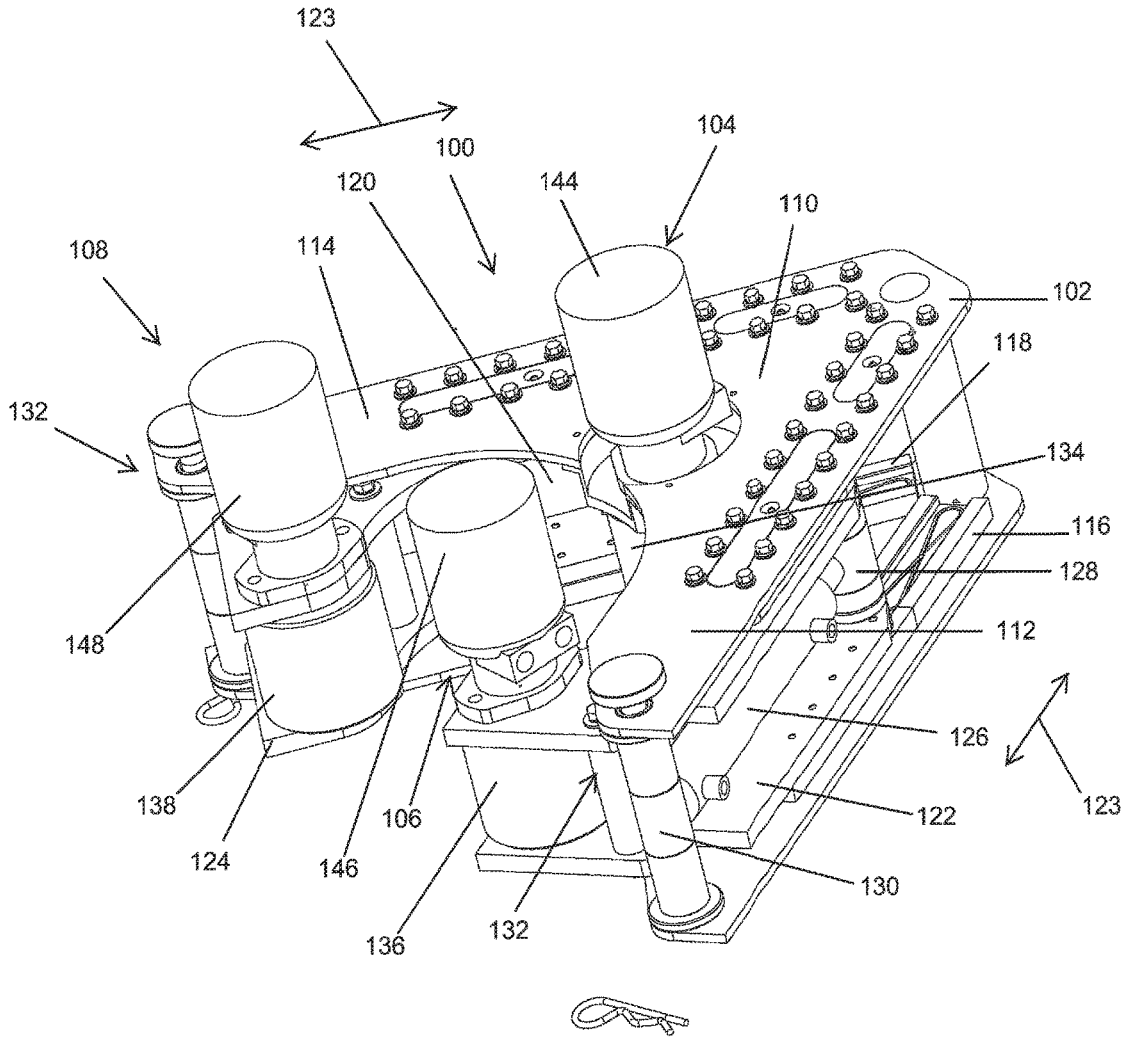
FIG. 1 is a perspective view of one example of an implementation of the apparatus in accordance with present invention.

The description of implementations below is presented for purposes of illustration. It is not exhaustive and does not limit the claimed invention to the precise forms disclosed. Modifications and variations are possible in light of the description below, or may be acquired from practicing the invention. The claims and their equivalents define the scope of the invention.

As illustrated in FIGS. 1-4, an apparatus 100 for spinning a tubular is provided. The apparatus 100 may include a frame 102, a center roller assembly 104, a first adjustable roller assembly 106, and a second adjustable roller assembly 108.

In particular, FIG. 1 is a perspective view of one example of an implementation of the apparatus 100 in accordance with present invention. As shown, the frame 102 may include a substantially V-shaped construction having a central region 110, and a first arm 112 and second arm 114 outwardly extending in angular opposition from the central region 110. Each arm 112, 114 carries a rail system 116, 118. The first arm 112 and second arm 114 define a well 120 therebetween.

The center roller assembly 104 may be coupled to the central region 110 proximate the well 120. Each adjustable roller assembly 106, 108 is coupled to a motor carriage 122, 124. Each motor carriage 122, 124 is slidably coupled to the rail system 116, 118 of each arm 112, 114, such that the adjustable roller assemblies 106, 108 may be linearly translated along the rail systems 116, 118 towards and, alternately, away from the center roller assembly 104 in a fixed angular orientation relative to the center roller assembly 104, as depicted by arrows 123. Each carriage 122, 124 is translated along the rail system 116, 118 by a hydraulic cylinder 126 coupled between the carriage 122, 124 at one end 128, and a pin assembly 132 coupled to the frame 102 at an opposite end 130. Each roller assembly 104, 106, 108 includes a drive roller 134, 136, 138 directly driven by motors 144, 146, 148, respectively.

Figure 2:
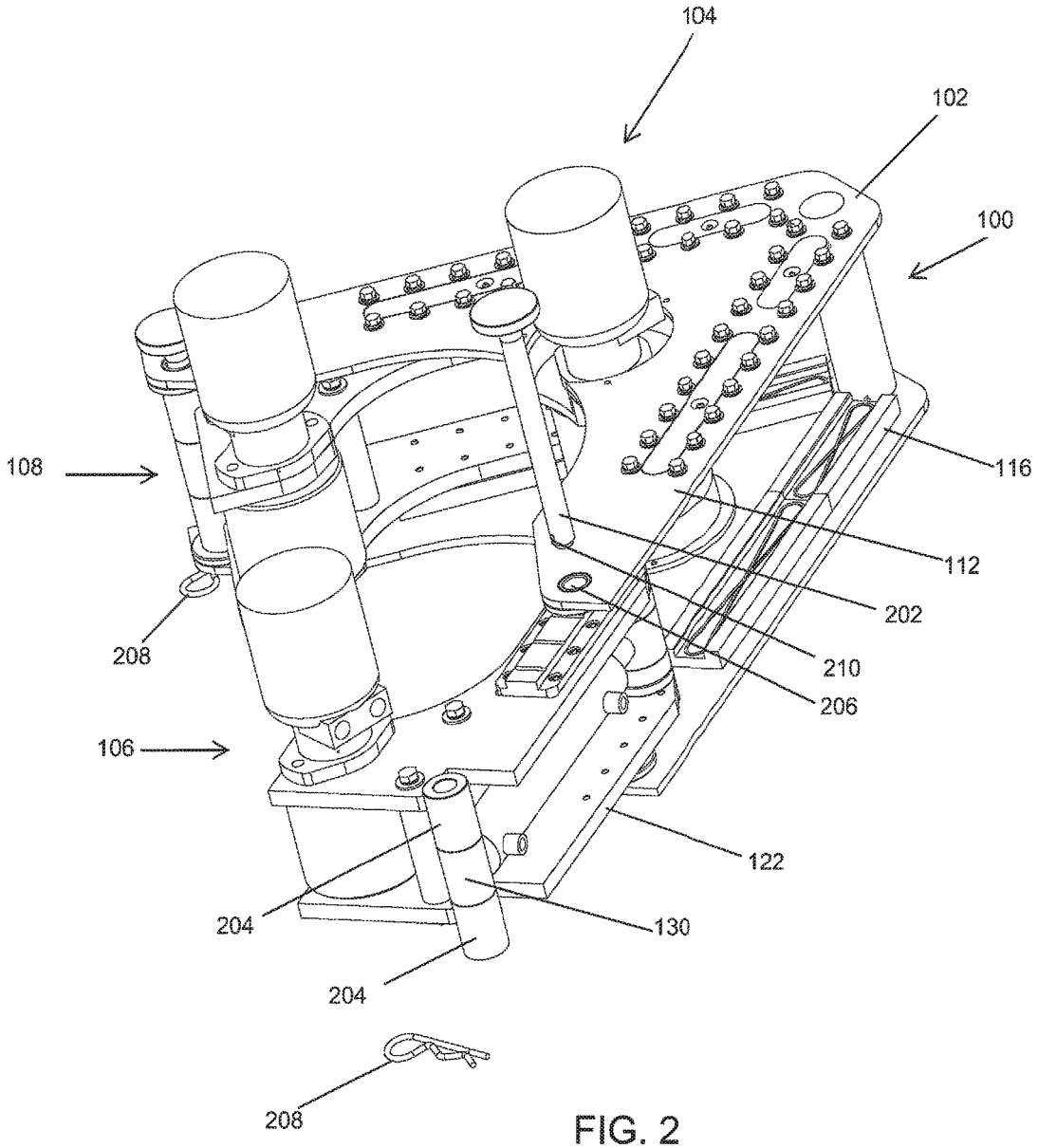
FIG. 2 is a perspective view of the apparatus illustrating an adjustable roller system detachably coupled to the frame at the pin assembly of each arm.

FIG. 2 is a perspective view of the apparatus 100 illustrating how an adjustable roller system 106 is detachably coupled to the frame 102 at the pin assembly 132 (FIG. 1) of each arm 112, 114. As shown, each pin assembly 132 includes a coupling pin 202 that is received by a pair of sleeves 204 coupled to a distal end of the motor carriage 122. The sleeves 204 are configured such that an end 130 of the hydraulic cylinder 126 may be disposed in corresponding alignment between them.

As specifically shown, the motor carriage 122 may be coupled to the frame 102 by inserting the coupling pin 202 through a pair of orifices 206 formed at a distal end of the arm 112. The sleeves 204 and end 130 of the cylinder may be disposed between and positioned in alignment with the orifices 206 such that the coupling pin 202 may pass and extend therethrough. Once the coupling pin 202 is installed through the orifices 206, the pin 202 may be secured to the frame 102 by a dowel pin 208, for example, that may be inserted into a pin hole 210 located and a bottom end of the pin 202.

In the alternative, the motor carriage 122, and thus the roller assembly 106, may be disassembled from the frame 102 by first removing the dowel pin 208 from the coupling pin 202, and then removing the coupling pin 202 from the orifices 206. Once the coupling pin 202 is removed from the orifices 206, the motor carriage 122 may be removed from the rail system 116. In this way, the roller assembly 106 may be disassembled from the frame 102 for maintenance, repair and replacement. Further, the rollers assemblies 106, 108 may be removed from the apparatus 100 without having to disassemble the frame 102.

Figure 3:
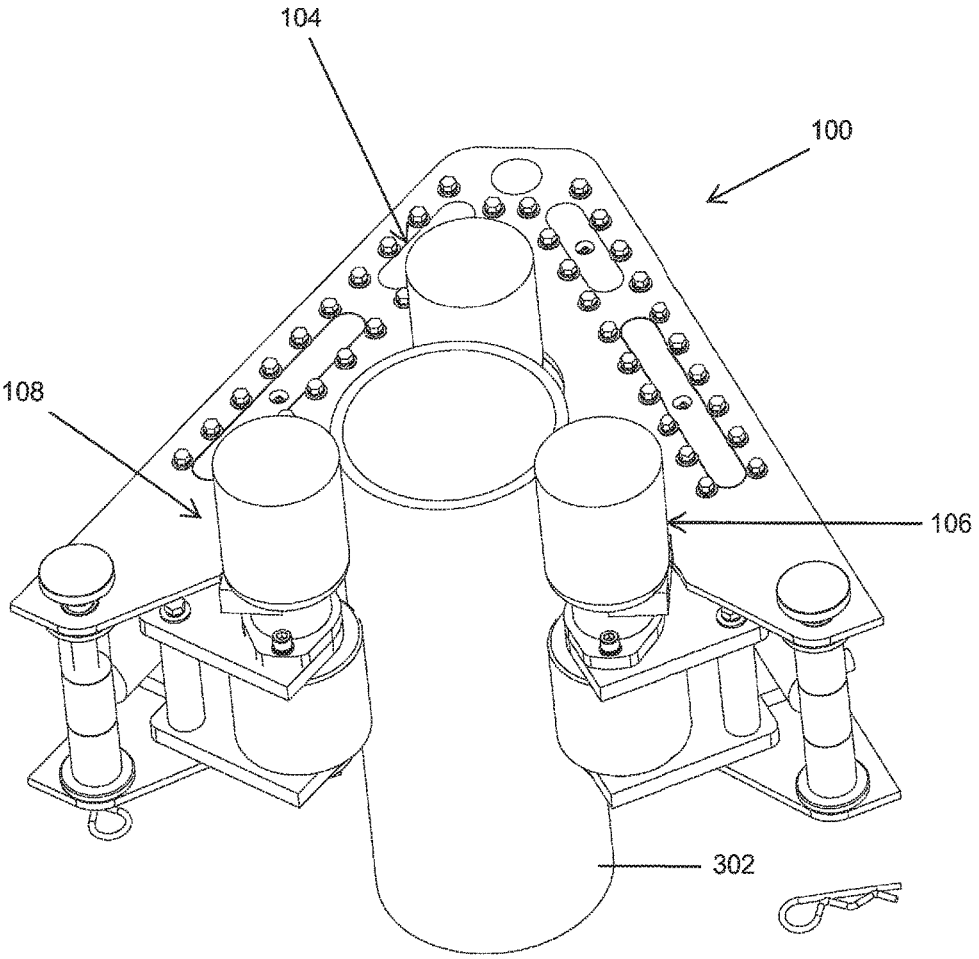
FIG. 3 is a perspective view illustrating the apparatus of FIG. 1 engaged with a tubular.

FIG. 3 is a perspective view illustrating the apparatus 100 engaged with a tubular 302 or pipe. To engage the tubular 302, the adjustable roller assemblies 106, 108 are initially translated to an open or extended position (not shown). The apparatus 100 is then brought into close proximity to the tubular 302 such that the tubular 302 is positioned in the well 120, between the roller assemblies 104, 106, 108. The hydraulic cylinders 126 are actuated to bring the adjustable roller assemblies 106, 108 into contact with the tubular 302. Thereafter, the cylinders 126 continue to linearly extend to pull the apparatus 100 toward the tubular 302 until all three roller assemblies 104, 106, 108 are in contact with the tubular 302, as shown in FIG. 3.

Figure 4:
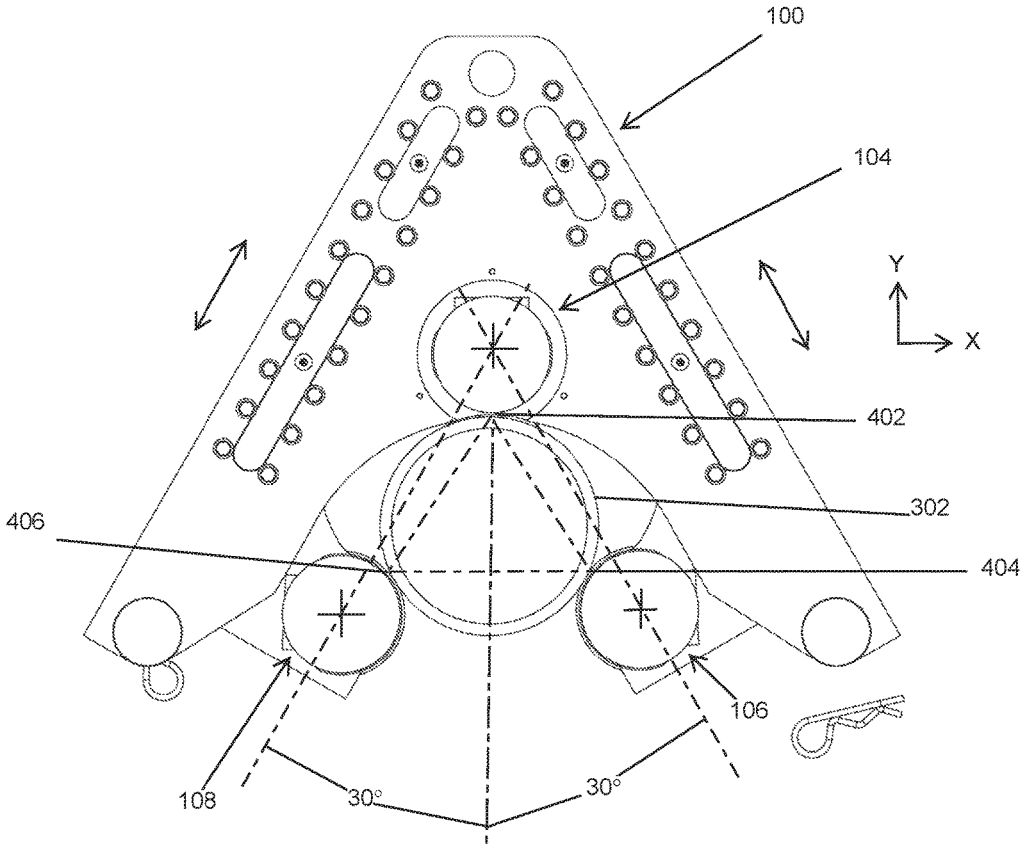
FIG. 4 is a top view of the apparatus of FIG. 1 engaged with the tubular.

FIG. 4 is a top view of the apparatus 100 engaged with the tubular 302. As shown, the adjustable roller assemblies 106, 108 may be translated linearly towards and, alternatively, away from the center roller assembly 104 to accommodate tubulars of varying dimensions. For example, the adjustable roller assemblies 106, 108 may be self-adjusted to accommodate tubulars with diametrical dimensions between approximately 2⅞ and 13⅜ inches. In accordance with the present invention, the drive rollers 134, 136, 138 of the adjustable roller assemblies 106, 108 will always engage the tubular 302, regardless of its size, at a set contact angle of, for example, 120° relative to the x-axis (30° relative to the drive roller of the center roller assembly 104). Thus, the rollers may maintain a three-point contact of 120°, as shown at points 402, 404, 406, to reduce triangulation of the tubular 302 as it is being spinned by the rollers 134, 136, 138.

An additional benefit of engaging a tubular 302 at the same angle, for example 120°, regardless of tube size, is that it enables the apparatus to engage the tubular with equal spinning loads at each contact point 402, 404, 406. Moreover, the translating adjustable rollers of the present invention provide a mechanical advantage over rollers that pivot into engagement with the tubular because rollers that pivot into engagement require more torque to keep the rollers engaged with the tubular due to the moment arm.

In another implementation of the invention, the design of drive rollers 134, 136, 138 of the present invention can be modified to allow the spinner to have a dual function and operate as a clamping device. As will be illustrated in more detail below, in connection with FIG. 5-11, the drive rollers 134, 136, 138 can be replaced with driver roller assembly 500, which is a driver roller having internal gear mechanisms. By adding internal gear mechanisms to the drive roller, the drive roller assembly 500 is able to apply additional torque on the tubulars, and thus, allow the spinner apparatus 100 to also operate as a clamping mechanism.

Figure 5:
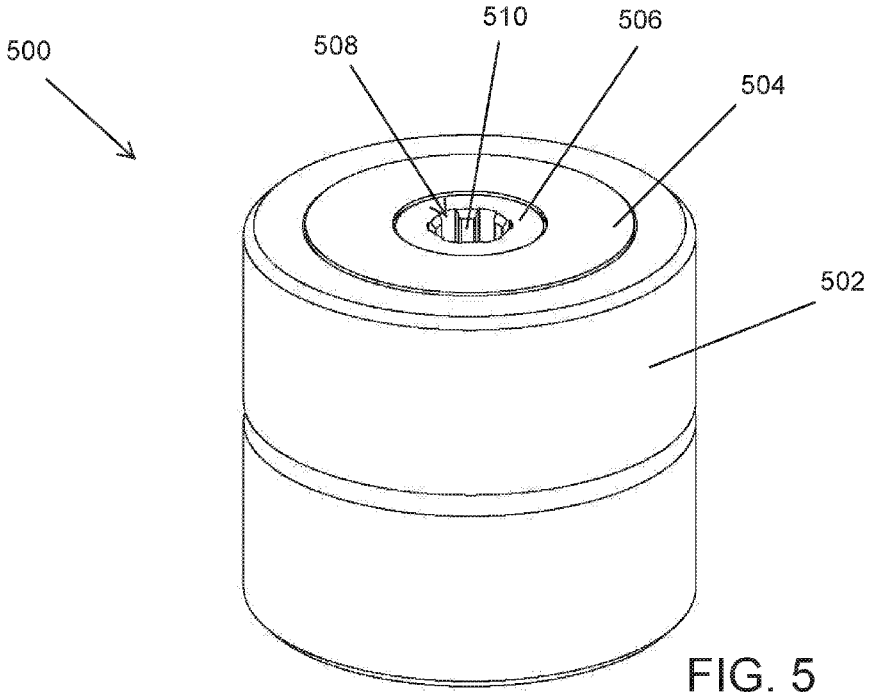
FIG. 5 is a front perspective view of one example of an implementation of a drive roller assembly of the present invention.
Figure 6:
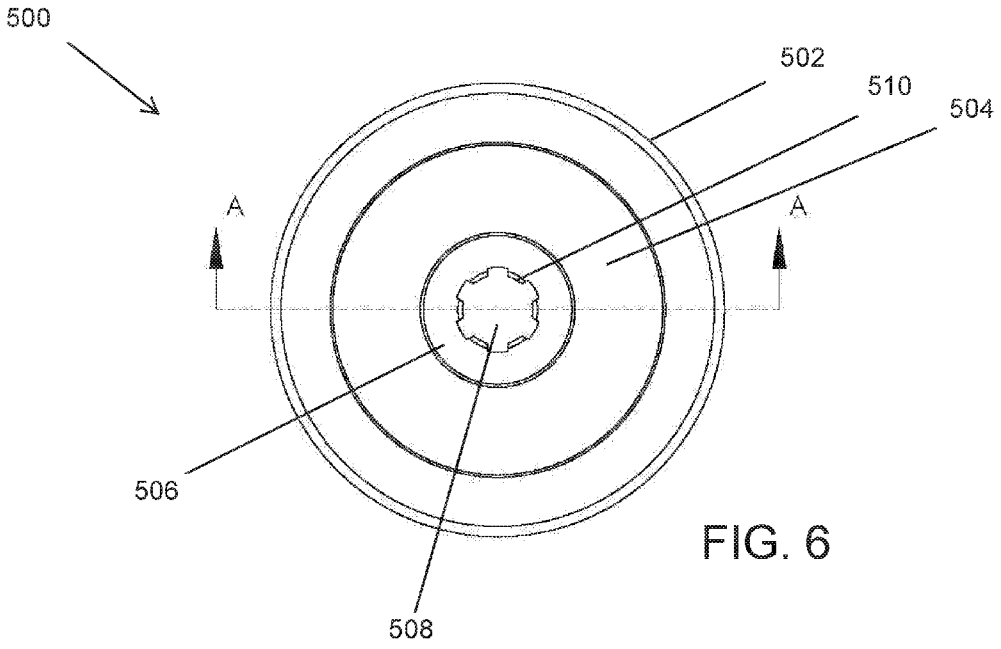
FIG. 6 is a top view of the drive roller assembly of FIG. 5.

FIG. 5 is a front perspective view of one example of an implementation of a drive roller assembly 500 having internal gear mechanisms, and FIG. 6 is a top view of the drive roller assembly 500 of FIG. 5. The drive roller assembly 500 can be used interchangeably with drive rollers 134, 136, 138 (FIG. 1). As illustrated in FIGS. 5 & 6, each drive roller assembly 500 includes a driver roller 502 enclosing the internal gears that allow the driver rollers 502 to apply additional torque on the tubulars. Housed within the driver roller 502 is a roller insert 504 that secures a modified sun gear 506. The modified sun gear 506 includes an opening 508 for receiving the drive shaft of a gear motor from 144, 146, 148 (FIG. 1) to rotate the driver roller assembly 500. The modified sun gear 506 includes ridges 510 within the opening for engaging the drive shaft of the gear motor 144, 146, 148 (FIG. 1), which provides for rotation of the drive roller 506. The outer surface of the drive roller 506 may be smooth to minimize the damage done to the tubular pipe when acting as a spinner or casing joint when acting as a clamping device.

Figure 7:
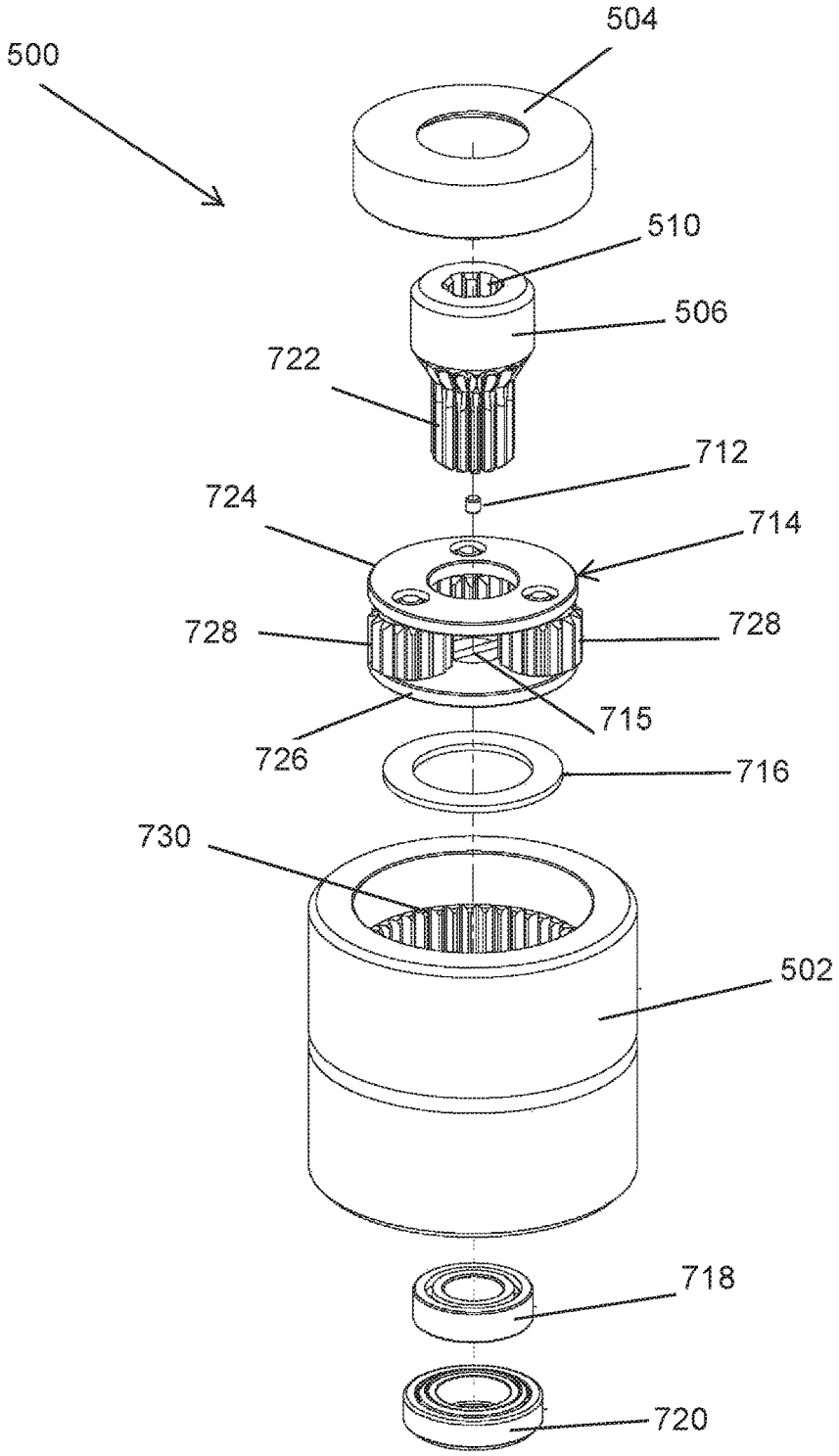
FIG. 7 is an exploded view of the drive roller assembly of FIG. 5.

FIG. 7 is an exploded view of the drive roller 500 assembly of FIG. 5. As shown in FIG. 7, the drive roller assembly 500 includes, from top to bottom: (i) a roller insert 504; (ii) a modified sun gear 506; (iii) a sun gear insert 712; (iv) a planet carrier assembly 714; (v) a high load thrust bearing 716; (vi) a drive roller 502; (vii) a high-load ball bearing 718 and (viii) a tapered roller 720.

As illustrated in FIG. 7, the modified sun gear 506 has external teeth 722 on the lower portion of the modified sun gear 506 for securely fitting in, and engaging, the planet carrier assembly 714. The lower portion of the modified sun gear 506 is positioned in an opening in the center of the planet carrier assembly 714. The modified sun gear 506 further includes a sun gear insert 712 that press fits into the bottom of the modified sun gear 506, which may be inserted in the modified sun gear 506 before inserting the modified sun gear 506 into the planet carrier assembly 714.

The planet carrier assembly 714 includes an upper plate 724 and a lower plate 726 and three planet gears 728 positioned there between, about the circumference of the plates 724 and 726 equidistant from one another. The upper plate 724 has a central opening for receiving the lower portion of the modified sun gear 506. The teeth 722 on the lower portion of the modified sun gear 506 engage the teeth on the three planet gears 728 when positioned within the central opening of the upper plate 724 of the planet carrier assembly 714.

The driver roller 502 is a hollow tube having a cavity that houses the planet carrier assembly 714, the modified sun gear 506, the high load thrust bearing 716, a high-load ball bearing 718 and a high-load tapered roller 720. The planet carrier assembly 714 and the modified sun gear 506 sit atop the high load thrust bearing 716, a high-load ball bearing 718 and a high-load tapered roller 720 within the cavity of the driver roller 502.

A ring gear 730 is located in the inner radius of the drive roller 506. The ring gear 730 includes cut teeth or cogs that engage the cut teeth of the three planet gears 728 of the planet carrier assembly 714.

Figure 8:
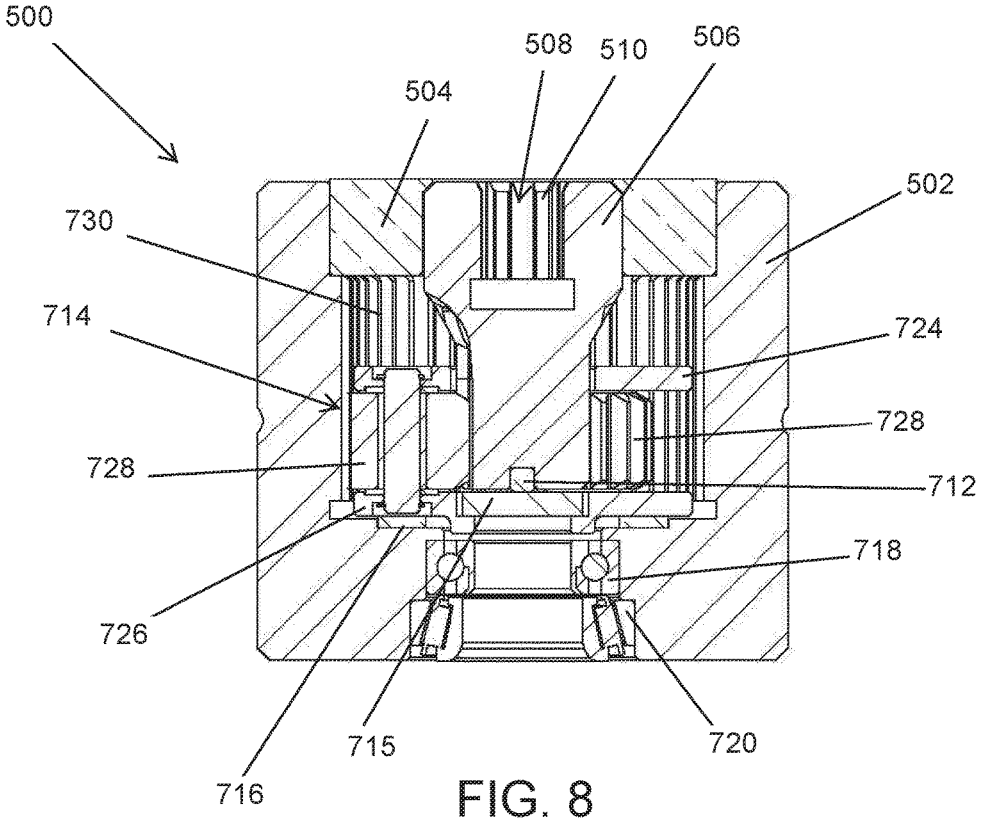
FIG. 8 is a cross-section view of the roller of FIG. 6, taken along lines A-A.

FIG. 8 is a cross-section view of the drive roller assembly of FIG. 6, taken along lines A-A. FIG. 8 best illustrates the assembly, engagement and the coupling of the various components of the drive roller assembly 500. As illustrated, the a roller insert 504 maintains the higher portion of the modified sun gear 506 within the planet carrier assembly 714 atop the high load thrust bearing 716, the high-load ball bearing 718 and the tapered roller bearing 720. The teeth of the lower portion of the modified sun gear 506 engage the teeth of the planet rollers 728 in the planet carrier assembly 714. The teeth of the planet gears 728 in the planet carrier assembly 714 thereby engage in the teeth of the ring gear 730 of the driver roller 502, when assembled. Thus, in operation, the rotation of the modified sun gear 506 (driven by the drive shaft of the motor) allows the rotation of the planet gears 728 in the planet carrier assembly 714 which in turn, rotates the driver roller 502 through engagement with the ring gear 730. This 3:1 gear ratio then provides three times (3×) the torque at one-third the speed.

Figure 9:
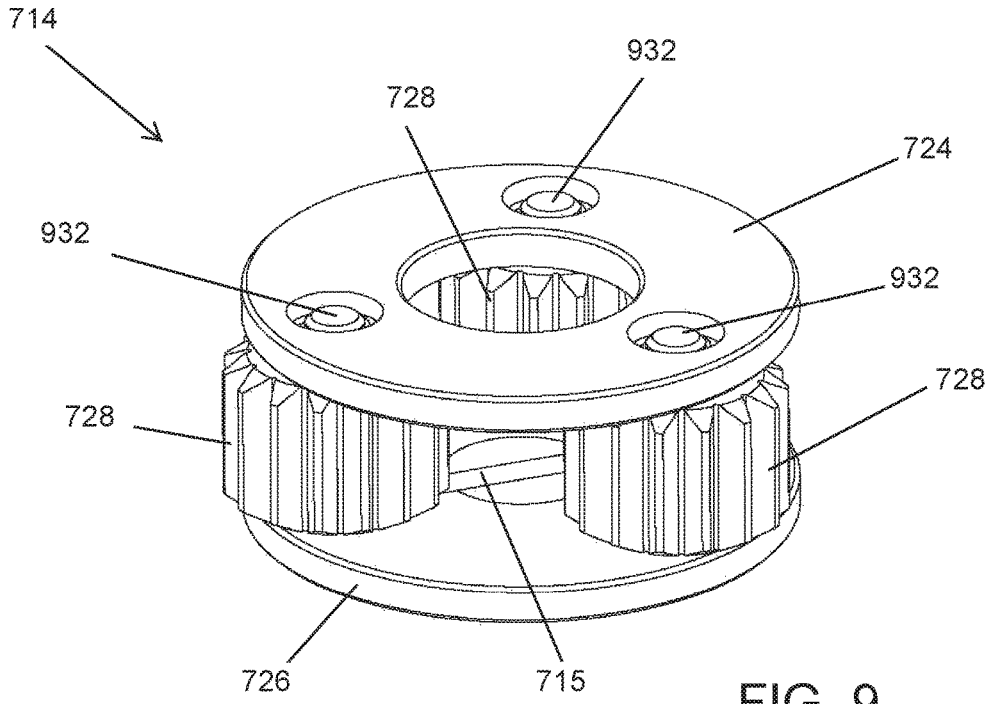
FIG. 9 is a top perspective view of the planet carrier assembly of the drive roller assembly of FIG. 5.

FIG. 9 is a top perspective view of the planet carrier assembly 714 of the drive roller assembly 500 of FIG. 5. As shown in FIG. 9, the planet carrier assembly 714 includes an upper plate 724 and a lower plate 726, with three planet gears 728 positioned between the upper and lower plates. The planet gears 728 are positioned equidistant from one another spaced about the circumference of the plate 724 and 726 and positioned such that the teeth of the planet gears 728 extend out past the outer circumference of the plates 724 and 726 for engagement with the ring gear 730 of the drive roller 502.

The upper plate 724 has a central opening for receiving the lower portion of the modified sun gear 506. The planet gears 728 rotate about dowel pins 932 that run from the upper plate 724 to the lower plate 726 and through the center of each planet gear 728. The three planet gears 728 are arranged to interact with both the ring gear 730 of the drive roller 502 and the modified sun gear 506 at the same time.

Figure 10:
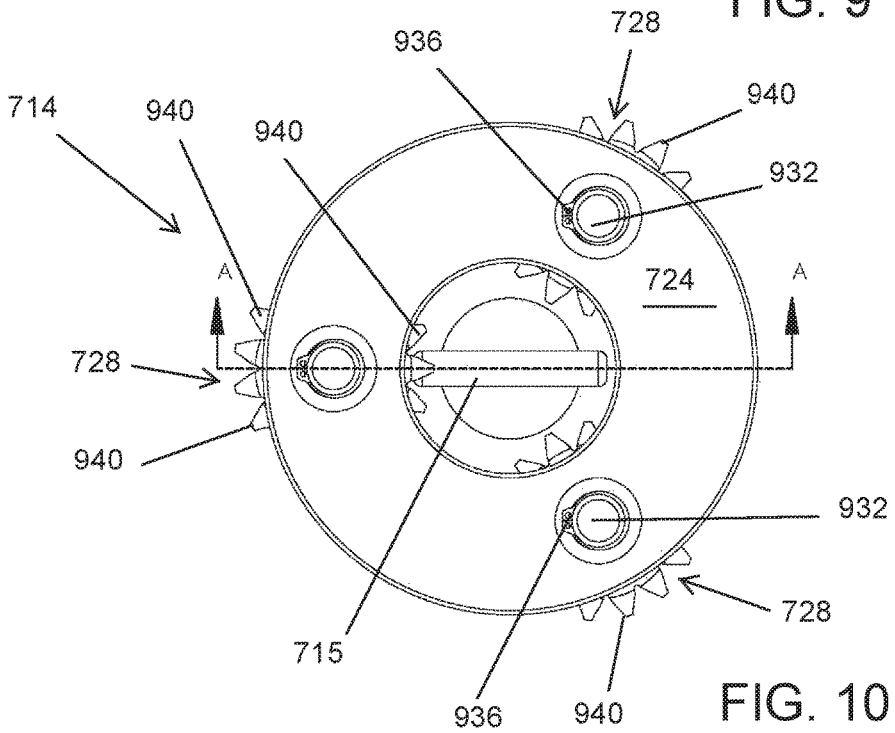
FIG. 10 is a top view of the planet carrier assembly of FIG. 9.

FIGS. 9 and 10 also illustrate the use of a machine key 715 positioned in grooves 960 (FIG. 11) that extend on the sides of the central opening of the lower plate 726. The machine key is engaged by the shaft (not shown) on the apparatus or spinner 100 that holds the drive roller assemblies 500 on the spinner 100. The engagement of the machine key by the shaft prevents the movement of the upper and lower plates 724 and 726 of the planet carrier assembly 714, while still allowing the planet gears 728 to rotate about the dowel pins 932. The machine key 715 is used to transmit the torque from the shaft to the planet carrier gear 714.

FIG. 10 is a top view of the planet carrier assembly 714 of FIG. 9. FIG. 10 best illustrates the equal size and spacing of the three planet gears 728 about the planet carrier assembly 714. The planet gears 728 rotate about the dowel pins 932 running from the upper plate 724 through the center of the planet gears 728 to the lower plate 726. The dowel pins 932 are secured on the upper and lower plates 724 and 726 by retaining rings 936. FIG. 10 illustrates the teeth 940 of the planet gears 728 extending outward past the upper and lower plates 724 and 726 for engagement with the ring gear 730 of the driver roller 502 and extending within the opening of the upper plate 724 for engagement with the teeth 722 on the lower portion of the modified sun gear 506 when inserted into the center of the planet carrier assembly 714. The concentricity of the planet gear 728 spacing with the modified sun gear 502 and ring gear 730 allows the torque to carry through a straight line thus, eliminating the need to redirect the power or relocate other components.

Figure 11:
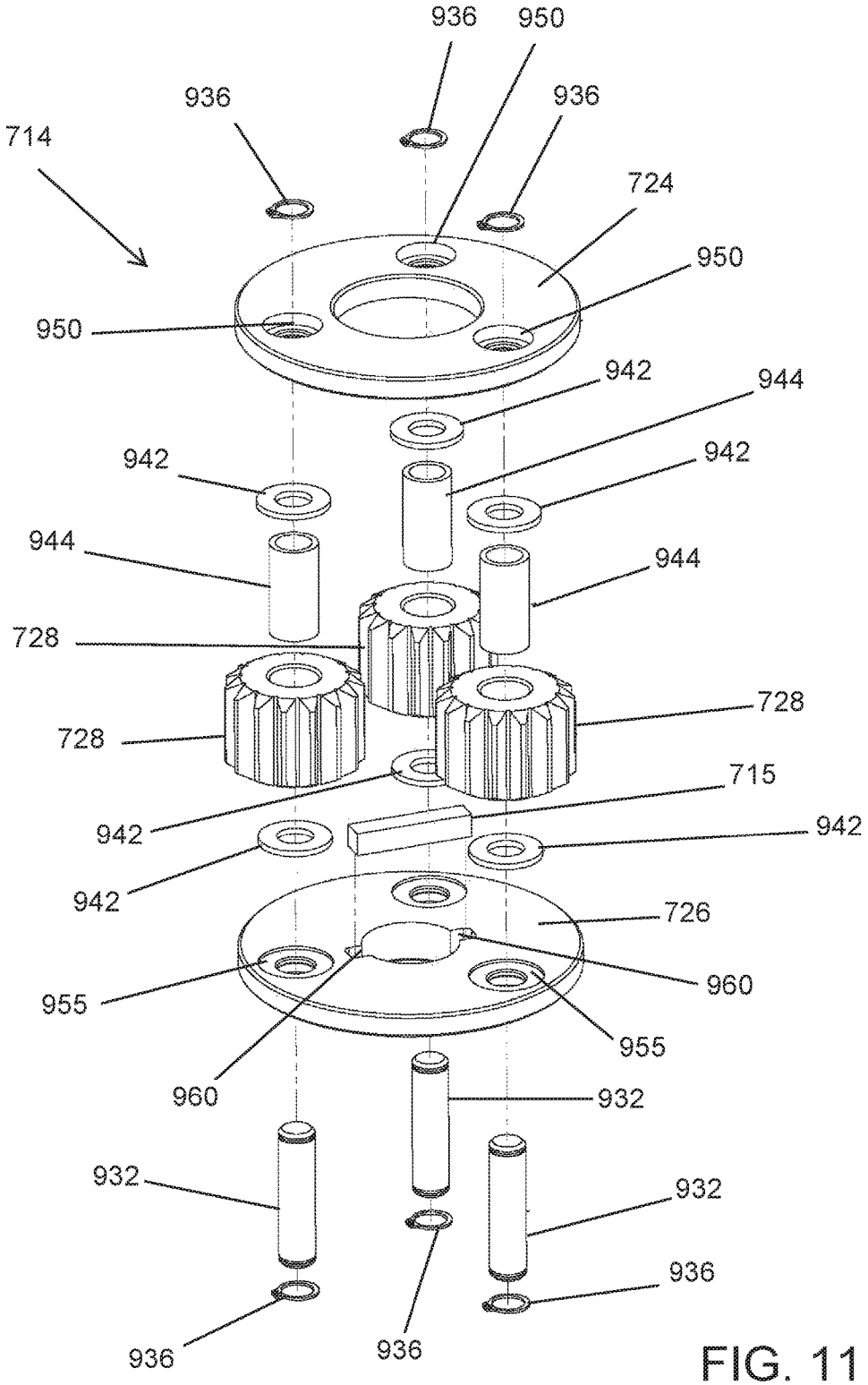
FIG. 11 is an exploded view of the planet carrier assembly of FIG. 9.

FIG. 11 is an exploded view of the planet carrier assembly 714 of FIG. 9. As illustrated in FIG. 11, the planet carrier assembly 714 includes, from top to bottom, the following components: (i) retaining rings 936; (ii) an upper plate 724; (iii) high-load thrust bearings 942; bearing sleeves 944; (iv) planet gears 728; (v) additional high-load thrust bearings 942; (vi) a machine key 715; (vii) a lower plate 726; (viii) dowel pins 932 and (ix) additional retaining rings 936.

The three planet gears 728 are held between the upper lower and plates 724 and 726 of the planet carrier assembly 714 by dowel pins 932 and bearing sleeves 944 that run through the center openings in the planet gears 728. The dowel pins 932 and bearing sleeves 944 allow the planet gears 728 to rotate above their center axis. The planet gears 728 are spaced about from the upper and lower plates 724 and 726 to allow for the planet gears 728 to spin freely between the plates by high-load thrust bearings 942 positioned above and below the planet gears 728 around the dowel pins 932. Both the upper and lower plates 724 and 726 have internal recesses 955 for receiving the bearings 942 and maintaining space between the planet gears 728 and the upper and lower plates 724 and 726. The dowel pins 932 run through the openings in the upper and lower plates 724 and 726 and extend into outer recesses 950 in both the upper and lower plates 724 and 726 that allow the dowel pins 932 to be secured to the upper and lower plates 724 and 726 with retaining rings 936 positioned within the outer recesses of the upper and lower plates 724 and 726.

Figure 12:
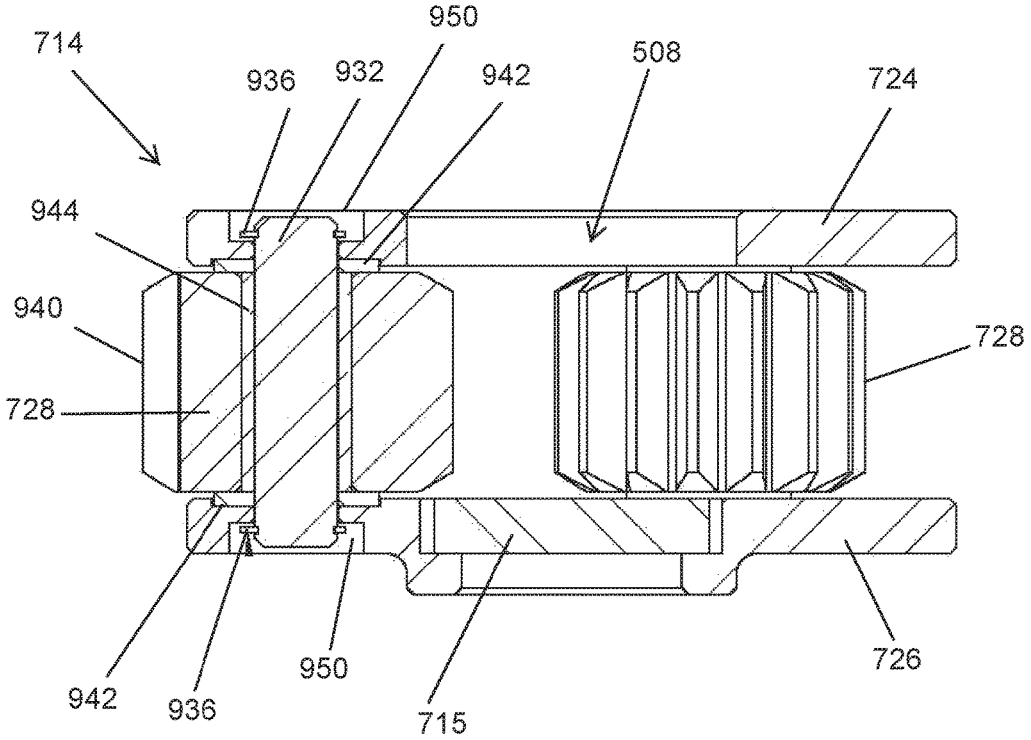
FIG. 12 is a cross-section view of the planet carrier assembly of FIG. 10 taken along line A-A.

FIG. 12 is a cross-section view of the planet carrier assembly 714 of FIG. 10 taken along line A-A. FIG. 12 best illustrates how the dowel pins 932 and bearing sleeves 944 extend through the center of the planet gears 728 and through openings on the upper and lower plates 724 and 726. The outer recesses 950 of the upper and lower plates 724 and 726 to allow for retaining rings 936 to be positioned below (or countersunk below) the outer surfaces of the plates 724 and 726. Inner recesses 955 receiving the high-load thrust bearings 942 and provide space between the planet gears 728 and upper and lower plates 724 and 726 to allow the planet gears 728 to freely spin between the upper and lower plates 724 and 726.

In operation, each gear motor 144, 146, 148 (FIG. 1) drives the modified sun gear 506, which rotates the set of three planet gears 728 on a stationary planet carrier assembly 714. The three planet gears then engage and rotate the ring gear 730 of the driver roller 502. The rotation of the modified sun gear 506 and planet carrier assembly 714 rotates the drive roller 502. By using this internal gear system, a gear ratio of 3:1 is delivered, thus providing three times the torque at one-third the speed. Incorporating this internal gear systems into the drive roller assemblies 500 delivers higher torque that permits the spinner/apparatus 100 to not only allow the rollers to make up drill pipe, but also to clamp casing joints. By being able to operate as both a drill spinner and clamping device, the vertical footprint of the apparatus is minimized as is the need to incorporate a taller external gear box to apply higher torque.

In general, terms such as "coupled to," and "configured for coupling to," and "secured to," and "configured for securing to" and "in communication with" (for example, a first component is "coupled to" or "is configured for coupling to" or is "configured for securing to" or is "in communication with" a second component) are used herein to indicate a structural, functional, mechanical, electrical, signal, optical, magnetic, electromagnetic, ionic or fluidic relationship between two or more components or elements. As such, the fact that one component is said to be in communication with a second component is not intended to exclude the possibility that additional components may be present between, and/or operatively associated or engaged with, the first and second components.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. An apparatus for spinning and clamping a tubular, the apparatus comprising: a frame having a first arm and a second arm outwardly extending in angular opposition from a central region, wherein each arm carries at least one rail and wherein the first arm and the second arm define a well therebetween; a center roller coupled to the central region of the frame proximate the well, where the center roller is permanently affixed in one position relative to the central region; a first adjustable roller slidably coupled to the first arm, wherein the first adjustable roller may be linearly translated towards and away from the center roller; a second adjustable roller slidably coupled to the second arm, wherein the second adjustable roller may be linearly translated towards and away from the center roller; and where at least one of the first adjustable roller, second adjustable roller and center roller includes internal gears to allow additional torque to be applied to the tubular when it is desired to have the apparatus clamp the tubular.

2. The apparatus of claim 1 where the at least one of the first adjustable roller, second adjustable roller and center roller includes internal gears further comprises a drive roller assembly, where the drive roller assembly includes a drive roller formed as a sleeve and having a ring gear located around at least part of the inner radius of the drive roller; a planet carrier assembly positioned within the drive roller, where the planet carrier assembly includes three planet gears having exterior teeth that engage with the ring gear located around at least part of the inner radius of the drive roller, the planet carrier assembly having a central opening; and a modified sun gear that is inserted into the central opening of the planet carrier assembly, the modified sun gear having lower external teeth for engaging the exterior teeth on the three planet gears of the planet carrier assembly.

3. The apparatus of claim 2, where the three planet gears provide a 3:1 gear ratio such that three times the torque is provided at one-third the speed.

4. The apparatus of claim 2, where the ring gear, planet carrier assembly, and modified sun gear are positioned concentrically in relation to one another.

5. The apparatus of claim 2, where the rotation of the modified sun gear provides for the rotation of the three planet gears, which in turn, rotates the at least one of the first adjustable roller, second adjustable roller and center roller.

6. The apparatus of claim 1 where the first adjustable roller, second adjustable roller and center roller all include internal gears to allow additional torque to be applied to the tubular when it is desired to have the apparatus clamp the tubular.

7. A method of rotating and clamping a tubular, the method comprising: providing a spinner having a center roller, a first adjustable roller, and a second adjustable roller, wherein a well is defined by the center roller, the first adjustable roller and the second adjustable roller, where the center roller is permanently affixed in one position relative to the well; positioning the spinner about the tubular such that the tubular is received by the well; translating the first and second adjustable rollers linearly towards the center roller; engaging the tubular by the center roller, first adjustable roller and second adjustable roller such that the tubular is gripped by the center roller and first and second adjustable rollers at three equidistant points, where at least one of the center roller, first adjustable roller and second adjustable roller includes internal gears within the rollers that provides additional torque for clamping the tubular; and driving at least one of the center roller, first adjustable roller and second adjustable roller to spin and clamp the tubular.

8. The method of claim 7 where the at least one of the first, second and center roller including internal gears further comprise a drive roller assembly, where the drive roller assembly includes a drive roller formed as a sleeve and having a ring gear located around at least part of the inner radius of the drive roller; a planet carrier assembly positioned within the drive roller, where the planet carrier assembly includes three planet gears having exterior teeth that engage with the ring gear located around at least part of the inner radius of the drive roller, the planet carrier assembly having a central opening; and a modified sun gear that is inserted into the central opening of the planet carrier assembly, the modified sun gear having lower external teeth for engaging the exterior teeth on three planet gears of the planet carrier assembly.

9. The method described in claim 7, where the ring gear, planet carrier assembly, and modified sun gear are positioned concentrically in relation to one another and where the three planet gears provide a 3:1 gear ratio such that three times the torque is provided at one-third the speed.

* * * * *